US007748207B2

(12) United States Patent
Wassenhoven et al.

(10) Patent No.: US 7,748,207 B2
(45) Date of Patent: Jul. 6, 2010

(54) YARN DRAW-OFF DEVICE FOR A TEXTILE MACHINE PRODUCING CROSS-WOUND BOBBINS

(75) Inventors: Heinz-Georg Wassenhoven, Mönchengladbach (DE); Maximilian Preutenborbeck, Mönchengladbach (DE); Wilhelm Oehrl, Erkelenz (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 323 days.

(21) Appl. No.: 11/992,693

(22) PCT Filed: Jul. 12, 2006

(86) PCT No.: PCT/EP2006/006792

§ 371 (c)(1),
(2), (4) Date: Mar. 27, 2008

(87) PCT Pub. No.: WO2007/042087

PCT Pub. Date: Apr. 19, 2007

(65) Prior Publication Data

US 2010/0058727 A1 Mar. 11, 2010

(30) Foreign Application Priority Data

Oct. 7, 2005 (DE) ..... 10 2005 048 041

(51) Int. Cl.
*D01H 4/08* (2006.01)

(52) U.S. Cl. ..... 57/417

(58) Field of Classification Search ..... 57/404–417
See application file for complete search history.

(56) References Cited

U.S. PATENT DOCUMENTS

| | | | | | |
|---|---|---|---|---|---|
| 1,837,562 | A | * | 12/1931 | Mayer | 165/89 |
| 1,992,989 | A | * | 3/1935 | Burns | 34/637 |
| 2,339,557 | A | * | 1/1944 | Runals | 34/115 |
| 2,729,027 | A | | 1/1956 | Slayter et al. | 49/17 |
| 3,814,064 | A | * | 6/1974 | Hanes | 123/222 |
| 5,168,694 | A | | 12/1992 | Raasch et al. | 57/84 |
| 5,212,528 | A | * | 5/1993 | Matsuda | 399/33 |
| 5,682,718 | A | | 11/1997 | Bennewitz et al. | 57/263 |
| 5,920,961 | A | * | 7/1999 | Hollingsworth | 19/100 |
| 6,116,012 | A | * | 9/2000 | Braun | 57/406 |
| 6,220,761 | B1 | * | 4/2001 | Bock et al. | 384/549 |
| 2002/0124547 | A1 | * | 9/2002 | Fietz | 57/414 |
| 2003/0038206 | A1 | | 2/2003 | Grecksch et al. | 242/475.6 |
| 2007/0006423 | A1 | * | 1/2007 | Pferdmenges et al. | 19/98 |

FOREIGN PATENT DOCUMENTS

| | | | |
|---|---|---|---|
| DE | 39 17 047 | A1 | 11/1990 |
| DE | 4431483 | C1 | 12/1995 |
| DE | 44 32 240 | A1 | 3/1996 |
| DE | 101 39 075 | A1 | 2/2003 |

* cited by examiner

*Primary Examiner*—Shaun R Hurley
(74) *Attorney, Agent, or Firm*—K&L Gates LLP

(57) ABSTRACT

Yarn draw-off device for a textile machine producing cross-wound bobbins with a yarn draw-off roller that can be driven by a single motor and an associated pressure roller which is driven via frictional engagement, characterised in that the yarn draw-off roller (10) has a rotationally symmetrical basic member (15) with devices (33), which, during the rotation of the yarn draw-off roller (10) produce an air flow which cools the yarn draw-off roller drive (13).

5 Claims, 2 Drawing Sheets

YARN DRAW-OFF DEVICE FOR A TEXTILE MACHINE PRODUCING CROSS-WOUND BOBBINS

CROSS-REFERENCES TO RELATED APPLICATIONS

This application claims the benefit of German patent application 10 2005 048 041.1, filed Oct. 7, 2005, herein incorporated by reference.

BACKGROUND OF THE INVENTION

The invention relates to a yarn draw-off device for a textile machine producing cross-wound bobbins and, more particularly, to a yarn draw-off device having a yarn draw-off roller that can be driven by a single motor and an associated pressure roller which is driven via frictional engagement.

Textile machines producing cross-wound bobbins, in particular open-end spinning machines, have, in the region of their workstations, a yarn draw-off device in each case, which during spinning operation, draws the yarn produced in a spinning mechanism out of the spinning mechanism and conveys it onward at a constant delivery speed in the direction of a winding device, where the yarn is wound to form a cross-wound bobbin.

The yarn draw-off devices consist here either, as described, for example, in German Patent Publication DE 44 32 240 A1 or in German Patent Publication DE 39 17 047 A1, of a drive shaft along the length of the machine, on which a pivotably mounted pressure roller rests in each case in the region of the workstations, or the yarn draw-off devices in each case have a single motor drive. Such yarn draw-off devices driven by a single motor are shown and described, for example, in German Patent Publication DE 101 39 075 A1. These yarn draw-off devices in each case have a relatively large yarn draw-off roller which can be driven by a single motor and a significantly smaller, pivotably mounted pressure roller, which is entrained via frictional engagement by the yarn draw-off roller during spinning operation.

The yarn draw-off roller, which can preferably be reversibly driven by a stepping motor, generally consists here of a rotationally symmetrical diecast or injection-moulded member, in other words consists of a one-pieced cast member, which has an inner fastening hub, an annular outer periphery and a closed connecting disc located in between.

The frequently poor cooling of the yarn draw-off roller drives is disadvantageous in these yarn draw-off devices which have proven successful per se. In other words, overheating of the yarn draw-off roller drives may occur during the spinning process in these known yarn draw-off devices, in particular in the case of unfavourable climatic conditions.

SUMMARY OF THE INVENTION

Proceeding from the aforementioned prior art, the invention is based on the object of developing a yarn draw-off device, in which adequate cooling of the yarn draw-off roller drive is constantly ensured during spinning operation.

This object is achieved according to the invention by providing an improved yarn draw-off device for a textile machine producing cross-wound bobbins with a yarn draw-off roller that can be driven by a single motor and an associated pressure roller which is driven via frictional engagement. According to the invention, the yarn draw-off roller has a rotationally symmetrical basic member with devices, which, during the rotation of the yarn draw-off roller, produce an air flow which cools the yarn draw-off roller drive.

Advantageous further configurations, features, advantages and embodiments of the yarn draw-off device of the invention are described hereinafter.

According to the invention, the yarn draw-off roller has a rotationally symmetric basic member which is configured in such a way that, during rotation of the yarn draw-off roller, an air flow is produced which cools the yarn draw-off roller drive.

In other words, the yarn draw-off roller operates in the manner of a fan. In this manner, the yarn draw-off roller drive is reliably prevented from being able to overheat.

The air flow produced during rotation of the yarn draw-off roller, even in difficult climatic conditions, always ensures adequate cooling of the drive.

It is provided in an advantageous embodiment that the basic member of the yarn draw-off roller is configured in one piece, but very substantially open. This means that, during the rotation of the yarn draw-off roller, an air flow is produced, which, flowing through the basic member, impinges on the housing of the yarn draw-off roller drive. The heat dissipation thus taking place leads to a significant cooling of the corresponding drive.

According to another feature of the invention, the basic member of the yarn draw-off roller has an outer bearing receiver for securing a thin-walled profiled metal ring, an inner hub for fastening the yarn draw-off roller to the motor shaft of the yarn draw-off roller drive and air blades arranged in between. The air blades, during the rotation of the yarn draw-off roller, initiate a clear, very substantially uniform air flow in the direction of the associated drive.

As further shown herein, the air blades are curved in the direction of rotation. In other words, the air blades have concavely curved faces which, when the regular yarn draw-off takes place, are located at the front in the direction of rotation of the yarn draw-off roller.

These concavely curved faces of the air blades ensure that the air is continuously pressed in the direction of the drive, with the result that good cooling of the yarn draw-off roller drive is ensured.

As described herein, the basic member of the yarn draw-off roller is manufactured as an injection-moulded or diecast part. Such injection-moulded or diecast parts can be produced relatively economically and to fit very precisely, in particular when larger piece numbers are produced.

BRIEF DESCRIPTION OF THE DRAWINGS

The invention will be described in more detail below with the aid of an embodiment shown in the drawings, in which.

DETAILED DESCRIPTION OF THE PREFERRED EMBODIMENTS

Figure 1:
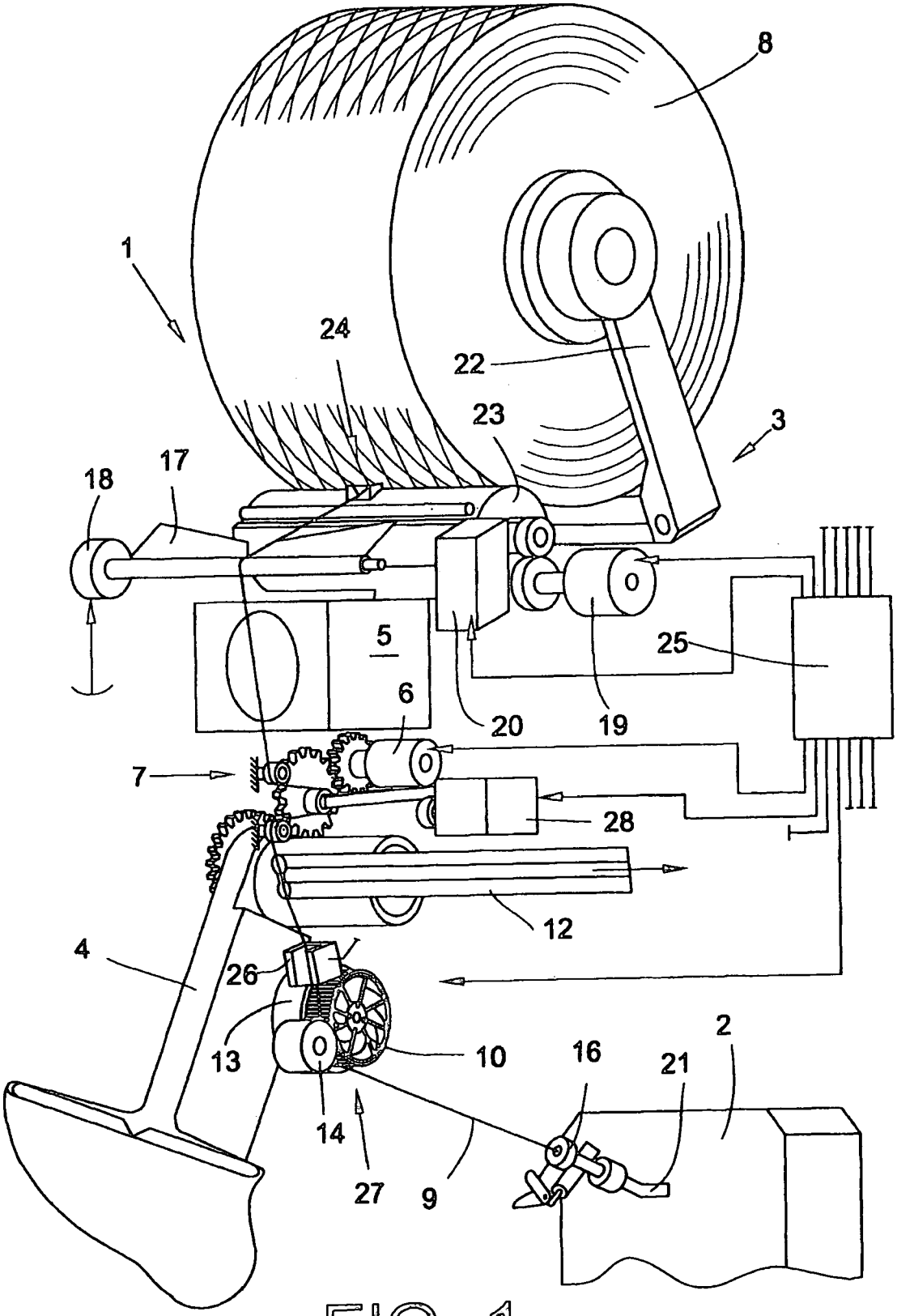
FIG. 1 perspectively shows a workstation of a textile machine producing cross-wound bobbins, with a yarn draw-off device driven by a single motor and a yarn draw-off roller according to the invention.

FIG. 1 shows a perspective view of a workstation 1 of an open-end rotor spinning machine. Workstations 1 of this type have, as known and therefore only shown schematically, an open end spinning mechanism 2 for producing a yarn 9 and a winding mechanism 3 on which the yarn 9 is wound to form a cross-wound bobbin 8. The yarn 9 produced in the open-end spinning mechanism 2 is drawn in this case from the open-end spinning mechanism 2 by a yarn draw-off device 27, which has a yarn draw-off roller 10 which can be driven by a single motor, and a pressure roller 14 which can be pivoted onto the yarn draw-off roller 10 and is entrained via frictional engagement thereby. As indicated in FIG. 1, the yarn 9 leaves the open-end spinning mechanism 2 through a so-called yarn draw-off tube 21. Also arranged in the region of the open-end spinning mechanism 2 is a pivotably mounted auxiliary piecing member 16, which, after a yarn break, takes over the yarn 9 retrieved by a suction nozzle 4 from the cross-wound bobbin 8 and prepares the yarn end for restarting the spinning.

Furthermore, a yarn stop motion 56, yarn storage devices 7 or 12 and a waxing device 5 are arranged downstream from the yarn draw-off device 27 in the yarn running direction. The yarn storage device 12 is configured, in this case, as a negative pressure-loadable storage nozzle, while the storage device 7 is configured as a mechanical yarn store. In other words, arranged between two stationary yarn guide members is an adjustable yarn guide member which, acted upon by a stepping motor 28, is movably arranged with respect to the yarn running path.

The winding device 3, as usual, consists of a creel 22 for the rotatable holding of a cross-wound bobbin 8, a bobbin drive drum 23 which can preferably be driven by a reversible single drive 19 and a yarn traversing device 24, which is driven, for example, by a stepping motor 20. Upstream of the yarn traversing device 24, a yarn centring device in the form of a pivotably mounted centring plate 17 may also be arranged, which, if necessary, can be folded by a drive 18 in a defined manner into the regular yarn running path.

Furthermore, workstations 1 of this type, as already indicated above, have a suction nozzle 4, which can be adjusted in a defined manner by means of a stepping motor 6 between a yarn receiving position located in the region of the winding device 3 and a yarn transfer position located in the region of the spinning mechanism 2.

The individual stepping motors of the workstation 1 are, as indicated in FIG. 1, connected via various control lines to a winding head computer 25.

The yarn draw-off device 27 consists, as already indicated above, substantially of a drivable yarn draw-off roller 10, a pressure roller 14 which can be pivoted onto the yarn draw-off roller 10 and is entrained thereby via frictional engagement and a yarn draw-off roller drive 13. The yarn draw-off roller drive 13 configured as a stepping motor is in turn connected via a control line 35 to a workstation computer 25. The yarn draw-off device 27 ensures during regular spinning operation, the drawing-off of the spinning yarn 9 from the open-end spinning mechanism 2 and also when spinning is restarted after a spinning operation, ensures the return of a prepared yarn 9 into the open end spinning mechanism 2.

Figure 2:
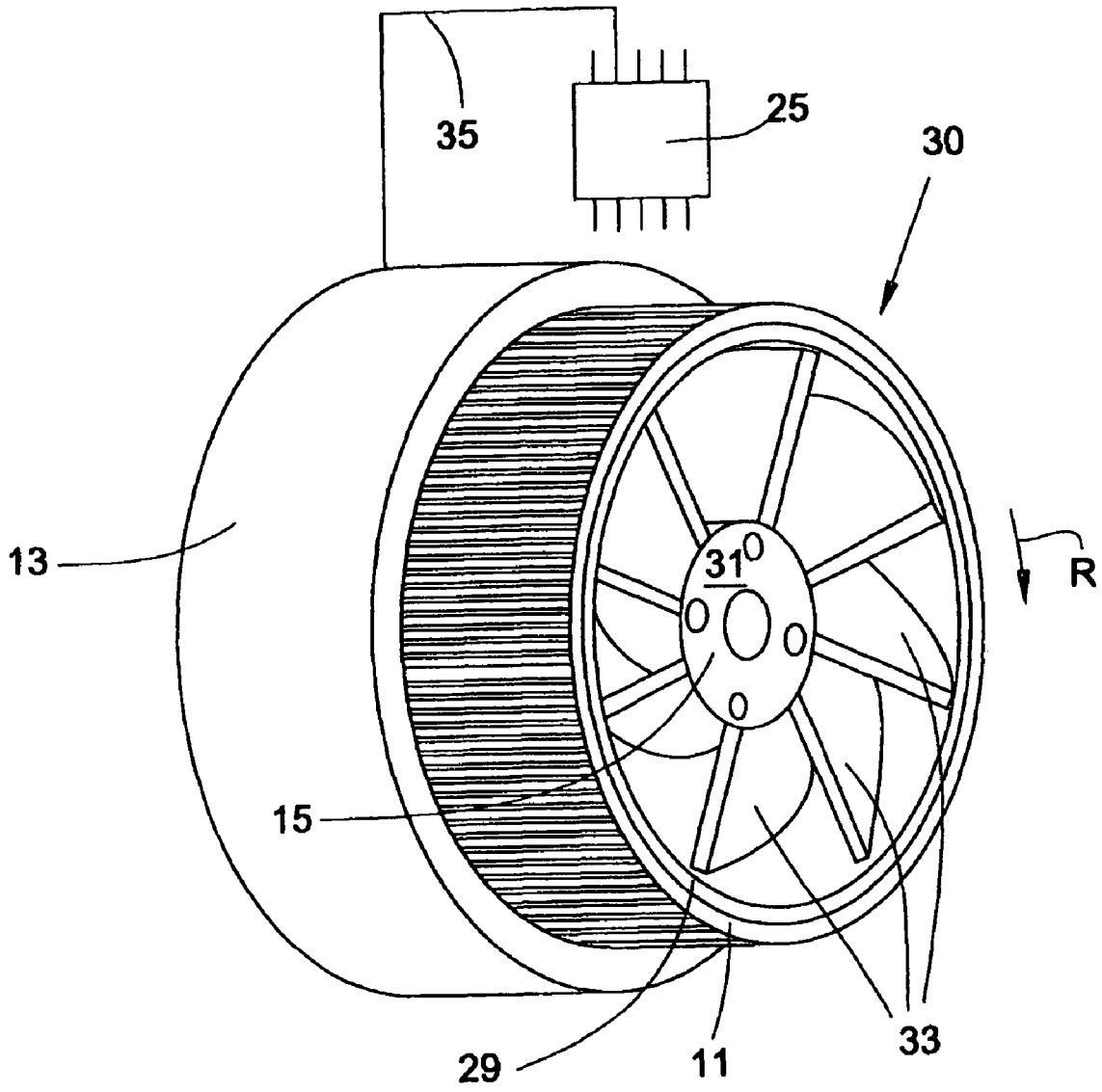
FIG. 2 shows a perspective view of a yarn draw-off roller according to the invention with a connected yarn draw-off roller drive.

As in particular shown in FIG. 2, the yarn draw-off roller 10 consists of a rotationally symmetrical basic member 15 manufactured, for example, by the injection-moulding or diecasting method. The basic member 15 in this case has a circular, outer bearing receiver 29, on which a thin-walled metal ring 11 profiled, for example, by high pressure internal forming and which preferably consists of steel or a stainless steel alloy, can be secured.

The thin-walled profiled metal ring 11, during the winding operation, is in contact with the yarn 9 and in conjunction with the abutting pressure roller 14 ensures that the yarn 9 is drawn off continuously from the open-end spinning device 2. The basic member 15 furthermore has an inner hub 31, via which the yarn draw-off roller 10 can be secured to the motor shaft 32 of the yarn draw-off roller drive 13.

Air blades 33, which operate in the manner of a fan 30 during the rotation of the yarn draw-off roller 10, extend between the hub 31 and the bearing receiver 29. In other words, the air blades 33 initiate an air flow which cools the yarn draw-off roller drive 13. As can also be seen from FIG. 2, the air blades 33 have faces, which are located at the front in relation to the direction R of rotation of the yarn draw-off roller 10 and are concavely curved.

What is claimed is:

1. Yarn draw-off device for a textile machine producing cross-wound bobbins with a yarn draw-off roller that can be driven by a single motor and an associated pressure roller which is driven via frictional engagement, characterised in that the yarn draw-off roller (10) has a rotationally symmetrical basic member (15) with devices (33), which, during the rotation of the yarn draw-off roller (10) produce an air flow which cools the yarn draw-off roller drive (13), wherein the basic member (15) of the yarn draw-off roller (10) has an outer, circular bearing receiver (29).

2. Yarn draw-off device according to claim 1, characterised in that the basic member (15) of the yarn draw-off roller (10) is configured in one piece but very substantially open.

3. Yarn draw-off device according to claim 1, characterised in that the bearing receiver (29) secures a thin-walled, profiled metal ring (11), an inner hub (31) for fastening the yarn draw-off roller (10) to the motor shaft (32) of the yarn draw-off roller drive (13) and air blades (33) arranged in between.

4. Yarn draw-off device according to claim 3, characterised in that the air blades (33) are curved in the direction (R) of rotation.

5. Yarn draw-off device according to claim 1, characterised in that the yarn draw-off roller (10) is manufactured as an injection-moulded part or diecast part.

* * * * *